United States Patent [19]

Van Slooten

[11] 4,231,267

[45] Nov. 4, 1980

[54] ROLLER HYDRAULIC VALVE LIFTER

[75] Inventor: Louis J. Van Slooten, West Olive, Mich.

[73] Assignee: General Motors Corporation, Detroit, Mich.

[21] Appl. No.: 956,644

[22] Filed: Nov. 1, 1978

[51] Int. Cl.[2] ..... F16H 53/06

[52] U.S. Cl. ..... 74/569; 123/90.48; 403/157; 29/513

[58] Field of Search ..... 74/569; 123/90.48, 90.5, 123/90.51; 29/513; 403/157

[56] References Cited

U.S. PATENT DOCUMENTS

| | | | |
|---|---|---|---|
| 188,764 | 3/1877 | Adams | 403/157 |
| 1,210,871 | 1/1917 | Suffa | 123/90.35 |
| 1,802,330 | 4/1931 | Boland | 123/90.5 |
| 2,435,727 | 2/1948 | Spencer | 74/569 |
| 2,735,313 | 2/1956 | Dickson | 123/90.48 |
| 3,200,801 | 8/1965 | Dornbos | 123/90.51 |
| 3,303,833 | 2/1967 | Melling | 123/90 |

FOREIGN PATENT DOCUMENTS

| | | | |
|---|---|---|---|
| 670628 | 12/1929 | France | 29/513 |

*Primary Examiner*—Kenneth Dorner
*Attorney, Agent, or Firm*—Arthur N. Krein

[57] ABSTRACT

A roller hydraulic valve lifter or similar cam follower mechanism wherein the follower of such an assembly or mechanism is provided with a pair of spaced apart struts to receive the opposed free ends of a roller shaft carrying a cam follower roller. Each free end of the roller shaft is provided with opposed flats parallel to the axis of the shaft to define abutment shoulders which engage the struts to limit axial movement of the roller shaft in the follower. Each strut is provided at its free end with a tang that is bent over to partly encircle a free end of the roller shaft whereby to retain the cam follower roller and roller shaft in unit assembly with the follower.

2 Claims, 4 Drawing Figures

ROLLER HYDRAULIC VALVE LIFTER

FIELD OF THE INVENTION

This invention relates to cam follower mechanisms and, in particular, to a cam follower roller arrangement for a hydraulic valve lifter.

DESCRIPTION OF THE PRIOR ART

To permit rolling contact between a rotating cam and, for example, a hydraulic valve lifter, it is well-known to use a cam follower roller suitably mounted on the bifurcated end of the valve lifter whereby the cam follower roller is positioned for rolling contact against the outer peripheral surface of the cam. To support the cam follower roller on the valve lifter, it has been the usual practice in the art, as shown for example in U.S. Pat. No. 2,735,313, entitled "Follower", issued Feb. 21, 1956 to John Dickson, to provide the lower end of the follower of the valve lifter with spaced apart depending arms which define the bifurcated end of the lifter. These arms are then bored whereby to provide a roller shaft hole in each of the arms. These bore holes are sized so as to receive a roller shaft on which the cam follower roller is rotatably journaled. In the assembly of the cam follower roller and roller shaft to the follower of the valve lifter, it is first necessary to insert one end of the roller shaft through the roller shaft hole in one of the arms after which the cam follower roller is mounted on the roller shaft. After the cam follower roller is mounted on the roller shaft and then it is further axially moved in a direction for insertion of this one end of the roller shaft into the roller shaft hole in the other arm. Thus opposite ends of the roller shaft are then positioned in the holes of the arms with the cam follower roller loosely sandwiched between these arms for rotation relative to the roller shaft. To axially retain the roller shaft within these arms, the material on the outboard side of each arm encircling the associated roller shaft holes is then spun over whereby to provide a flange projecting radially inward of the hole whereby to provide a retainer lip against which an end of the roller shaft can abut, as shown for example in the above identified U.S. Pat. No. 2,735,313.

Applicant has discovered that during the initial assembly of the roller shaft through the roller shaft hole in the first arm, that the surface of the roller shaft may be scratched or nicked. If such scratches or nicks occur on the portion of the roller shaft on which the cam follower is rotatably journaled and, if such scratches or nicks are then discovered during assembly, rebuilding of this portion of the valve lifter is then required. On the other hand, if these nicks or scratches are not discovered during final assembly, and the valve lifter is then placed into operation, premature failure of the cam follower roller and of the roller shaft will occur.

Applicant has also discovered that the small scratches or nicks on the roller shaft are not quite as serious as above-mentioned, if the cam follower roller is rotatably journaled on the roller shaft by means of a needle bearing assembly. However, even then, the use of a needle bearing in such an assembly does not always result in the non-failure of this assembly due to the presence of scratches or nicks on the roller shaft as a result of insertion of the roller shaft in a bore hole of a depending arm of the valve lifter. It is also apparent that the use of a needle bearing assembly in an attempt to overcome the above-described problems resulting from nicks or scratches on the roller shaft adds to the overall cost of each valve lifter.

In addition, line boring of the two roller shaft holes in the arms of the follower portion of the valve lifter is presently required in such conventional type roller hydraulic valve lifters, as described hereinabove.

SUMMARY OF THE INVENTION

The present invention relates to a roller hydraulic valve lifter or similar cam follower mechanism, wherein a follower body is provided with two pairs of oppositely facing depending struts thereon with a roller space therebetween, the spacing between the opposing struts being sized so as to slidably receive the flat ends of a roller shaft therebetween, the free ends of the struts then being forced over to partly encircle the end portions of the roller shaft whereby to retain the roller shaft and a cam follower roller rotatably mounted thereon to the follower.

It is therefor a primary object of this invention to provide an improved roller hydraulic valve lifter and method of assembling the same wherein the follower of the lifter mechanism is provided with spaced apart sets of opposed pairs of depending struts, with each set of struts spaced apart so as to receive the flat end of a roller shaft, rotatably supporting a cam follower roller, therebetween the free ends of the struts then being bent partly over the roller shaft whereby to secure it against movement relative to the follower.

Another object of the invention is to provide an improved cam follower mechanism wherein the roller shaft supporting a cam follower roller is provided with opposed flats on opposite ends thereof whereby the roller shaft can be inserted between the depending sets of pairs of opposed struts of a follower body, with these struts then being sent around the roller shaft to retain the roller shaft from moving axially out of position and also to prevent the roller shaft assembly from coming out of the follower body if a no-follow condition of the valve train should occur.

A further object of the invention is to provide an improved cam follower mechanism that is easy and economical to construct.

For a better understanding of the invention, as well as other objects and further features thereof, reference is had to the following detailed description of the invention to be read in connection with the accompanying drawings wherein:

Figure 1:
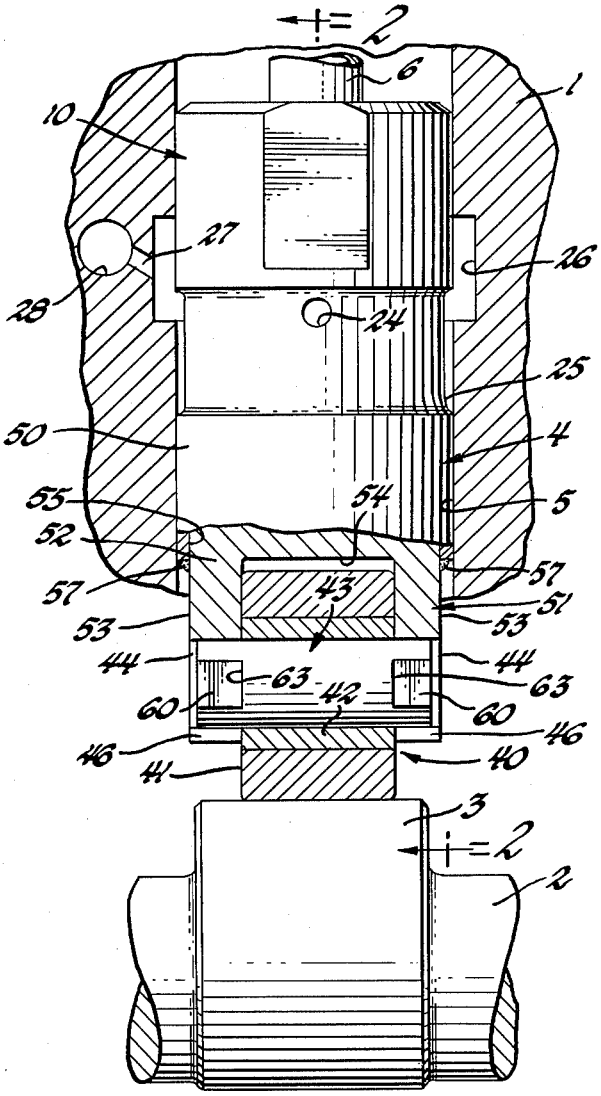
FIG. 1 is an elevational sectional view of a portion of the valve train mechanism for an internal combustion engine having a roller hydraulic valve lifter constructed in accordance with the invention associated therewith.
Figure 2:
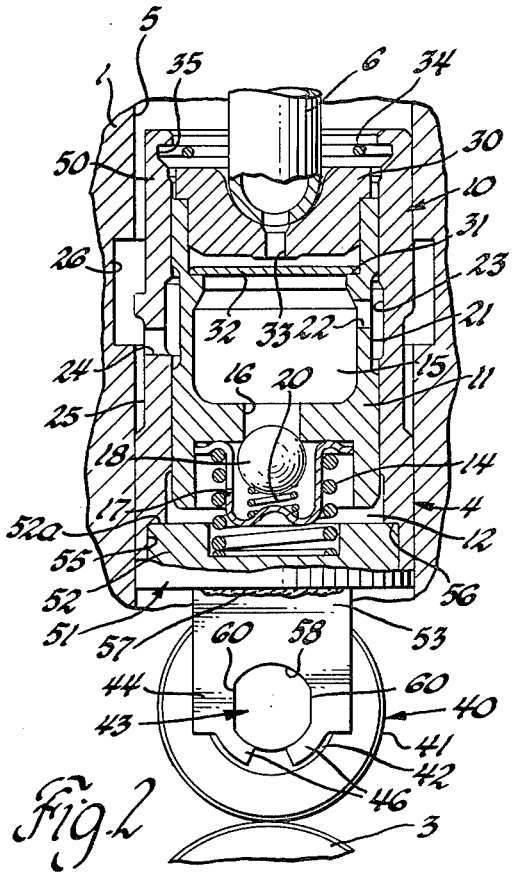
FIG. 2 is a sectional view taken along line 2—2 of FIG. 1.

Referring now in particular to FIGS. 1 and 2, there is shown a portion of the cylinder block 1 of an internal combustion engine in which a cam shaft 2 is suitably rotatably journaled. A cam 3 on the cam shaft 2 operatively engages a roller hydraulic valve lifter, generally designated 4, so as to cause it to reciprocate in a suitable guide bore 5 formed for this purpose in the cylinder block 1. The roller hydraulic valve lifter 4 may be used for example as a portion of the valve train for the engine to effect opening movement of a valve, not shown, by a hollow push-rod 6 acting on one end of a conventional rocker arm, not shown, in a manner well-known in the engine art.

The roller hydraulic valve lifter 4, except for its cam follower mechanism to be described in detail hereinafter, may be of any suitable type and, in the construction illustrated, is of the type disclosed in U.S. Pat. No. 3,450,228 entitled "Hydraulic Valve Lifter" issued on June 17, 1969 to Donald E. Wortman, Barry W. Norton and Elias W. Scheibe. Thus in the construction shown, the roller hydraulic valve lifter 4 comprises a cup-shaped cylindrical follower 10 having a cup-shaped plunger 11 telescopically slidable therein and defining an oil pressure chamber 12 between their respective closed end. Within this pressure chamber 12 and biasing the plunger outward of the cylindrical follower 10 is a plunger spring 14. The interior of the plunger 11 forms a reservoir chamber 15 for supplying hydraulic fluid to the pressure chamber 12 through a check valve controlled passage 16. Secured to the lower end of the plunger 11 by the plunger spring 14 is a cage 17 which loosely confines the check valve 18. A valve spring 20 supported within the cage 17 normally biases the check valve 18 to a closed position blocking flow from the pressure chamber 12 to the reservoir chamber 15 through control passage 16.

The plunger 11 is provided with an external annular groove 21 and a side port 22 leading therefrom to connect with the reservoir chamber 15. To insure that the reservoir chamber 15 is maintained full of hydraulic fluid, such as lubricating oil, at all times for necessary replenishment of fluid to the pressure chamber 12 and for delivery of oil out through the hollow push-rod 6 for lubricating the rocker arm, not shown, and other elements of the valve train in a conventional manner, provisions are made for a hydraulic fluid inlet to the reservoir chamber 15 through the cylindrical follower 10 from the pressure lubricating system of the engine.

These provisions, as shown, include an internal annular groove 23 in the cylindrical follower 10 having continuous registry with the groove 21 of the plunger throughout the range of relative reciprocal movement of the plunger 11 within the cylindrical follower 10 during engine operation. Intersecting the internal groove 23 and leading to the outer peripheral of the cylindrical follower 10 is a side port 24 provided in the cylindrical follower. The side port 24 intersects an external annular groove 25 formed in the cylindrical follower 10. Groove 25 has registry via a recess 26 with a port 27 in the cylinder block 1. The port 27 is supplied with oil from a gallery 28 which extends longitudinally of the engine cylinder block 1 and forms part of the oil pressure lubricating system of the engine, as well-known in the art.

The upper end of the plunger 11 is counter-bored to receive a push-rod seat 30 which is flanged at its upper end whereby to provide a radial shoulder adapted to rest on the open upper end of the plunger 1, as shown in FIG. 2. A shoulder 31 in the plunger formed by this counter-bore in the plunger 11 acts as a retainer for a plate-like flow control valve 32 which serves to meter oil flow to the push-rod 6 from the reservoir chamber 15 through a central outlet 33 in the push-rod seat 30. The plunger 11 and the push-rod seat 30 thereon and other associated members described above are axially retained in unit assembly within the cylindrical follower 10 by means of a split-ring retainer 34 positioned in a suitable annular groove 35 provided for the purpose in the upper open end of the cylindrical follower 10.

Now in accordance with the invention, the cylindrical follower 10 is provided with a cam follower roller assembly 40 that includes a cam follower roller 41 rotatably journaled by a cylindrical bearing bushing 42 supported on a roller shaft 43 between the ends thereof, in the construction illustrated. The roller shaft 43 is supported at opposite ends by spaced apart sets of opposed pairs of struts 44 of the cylindrical follower 10. These struts 44 are arranged so as to define a pair of aligned, blind, roller shaft receiving slots 45. The struts 44 are also provided with depending tangs 46 at their free ends which are forced over, as shown in FIG. 2, as described in detail hereinafter whereby to retain the roller shaft 43 to the cylindrical follower 10.

The struts 44 with their depending tangs 46 can be formed as an integral part of the cylindrical follower 10 or, preferably, as illustrated in the construction shown in FIGS. 1 and 2, the cylindrical follower 10 is formed as a two-piece assembly that includes an open ended cylinder member 50 and a roller shaft retainer 51.

Figure 3:
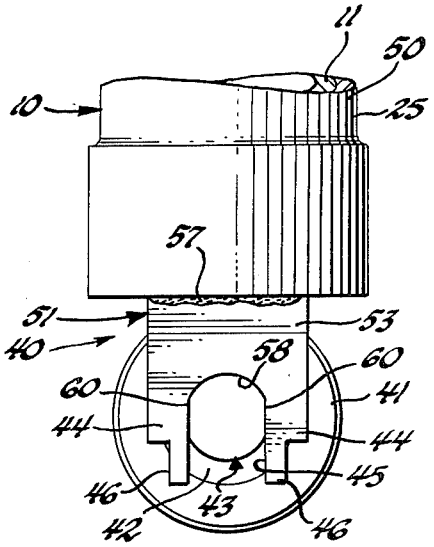
FIG. 3 is a view similar to a portion of FIG. 2 but showing the strut tangs of the follower in there as formed configuration prior to being bent around portions of the roller shaft; and, FIG. 4 is a perspective view of the roller shaft, per se, of the cam follower mechanism shown in FIGS. 1–3.

The roller shaft retainer 51, in the construction shown, includes an upper circular disc support 52 that is provided with a pair of integral transversely spaced apart depending arms 53. Each arm 53, as seen in FIGS. 2 and 3, is provided with an integral opposed pair of the spaced apart struts 44 depending therefrom. Each pair of opposing struts 44 together with their associated tangs, the latter as originally formed, as seen in FIG. 3, are spaced apart a predetermined distance whereby to provide one of the roller shaft receiving slot 45 therebetween. As best seen in FIG. 1, the opposing inner faces of the arms 53 and the inner faces of their associated struts 44 are equally spaced apart about the longitudinal axis of the cylindrical follower 10 so as to define a roller receiving slot 54 of a suitable predetermined width to loosely receive the cam follower roller 41 and the bearing bushing 42 whereby these elements are free to rotate relative to the roller shaft 43 between these surfaces.

As shown in FIG. 2, the cylinder member 50 is provided with a stepped bore therethrough that defines in part, for purposes of this disclosure, an internal cylindrical lower wall 55 extending from the lower end of the cylinder member 50 a predetermined axial distance to terminate at a radial inward extending flat shoulder 56. The lower wall 55 is of a predetermined diameter so as to slidably receive the circular disc support 52 end of the roller shaft retainer 51, with the upper surface 52*a* of the disc support 52 being positioned to abut against the shoulder 56. With the shaft retainer 51 thus positioned in the cylinder member 50, these parts are then suitably fixed together, for example, as shown in FIG. 1 as by brazing or welding at 57 whereby to form a unitary cylindrical follower 10 structure.

By making the cylindrical follower 10 as a two-part assembly, as described, with this assembly consisting of the cylinder member 50 and the roller shaft retainer 51, both of these components can readily be fabricated as such separate parts and can be made of different materials, if desired. For example, the subject roller shaft retainer 51 can be a cold formed part of steel and then assembled after fabrication to the cylinder member 50 in the manner described. Cold forming of the roller shaft retainer is advantageous since it reduces the cost of fabrication of this portion of the cylindrical follower 10 and thus of this follower assembly. In addition it provides the added benefit of increased strength of the arms 53 and, in particular, of the struts 44 of this assembly, due to the cold forming of this material. On the other hand, the cylinder member 50 can be made, for example, of either steel or a ductile iron, as desired, depending on the application in which it is to be used. If made of a suitable steel, this part can also be cold formed.

Each tang 46 as originally fabricated and as seen in FIG. 3 is formed as a straight extension of its associated strut and thus each pair of tangs 46 as formed define an extension of the associated slot 45 defined by spaced apart opposing struts, that is adapted to receive an end of the roller shaft 43 during assembly of this roller shaft thereto.

The junction between the opposing faces of each pair of struts 44 with the associated arm 53 is in the form of a fillet 58, as seen in FIGS. 2 and 3, the concave surface of this fillet being formed semi-circular to conform to the outside diameter of the roller shaft 43 and in particular to the portions 62 thereof to be described.

Roller shaft 43, of a predetermined outside diameter and of a predetermined axial length, both as desired, is provided with opposed flats 60 at opposite ends thereof and with an intermediate circular straight journal portion 61. The flats extend parallel to the axis of the roller shaft and the distance across the flats 60 is of a predetermined extent relative to the width of the slots 45 so that the flats 60 on an end of the shaft 43 can be slidably received in an associated slot 45. Preferably only a single set of opposed flats 60 is provided at each end of the roller shaft with these flats then being interconnected at opposite ends by semi-circular opposed exterior portions 62 that are of the same diameter as the diameter of the journal portion 61 for a purpose which will become apparent.

Figure 4:
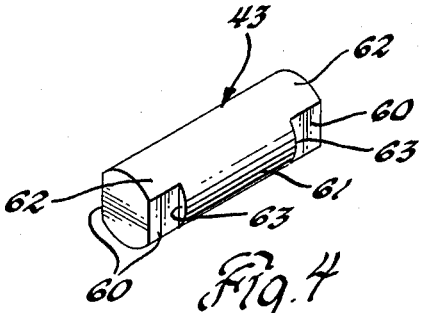

Again referring to FIG. 4, the in-board end of each flat 60 terminates at a radial flat shoulder 63 at substantially right angles to the axis of the roller shaft. Thus at opposite ends of the journal portion 61, the roller shaft 43 is provided with a pair of shoulders 63 on opposite sides thereof which are operative to serve as abutment shoulders in the assembly of the cam follower roller assembly 50 to the cylindrical member 10 as shown in FIGS. 1 and 2. These abutment shoulders 63 are thus positioned so as to be operative to limit movement of the roller shaft 43 within the cylindrical member 10 in a direction parallel to the axis of the roller shaft. For this purpose, the axial extent between sets of abutment shoulders 63 is made slightly less than the width of the roller receiving slot 54 so that these shoulders on opposite sides of the journal portion 61 can be slidably received between the inner faces of the pairs of struts 44, as seen in FIG. 1.

To assemble the cam follower assembly 40 to the cylindrical follower 10, the bushing 42 and cam follower roller 41 are first assembled to the roller shaft 43 in centered axial position thereon, that is, on the journal portion 61 thereof. This assembly is then inserted into the lower end of the cam follower 10 as shown in FIG. 3, with the opposite ends of the roller shaft 43 with the flats 60 thereon received in the spaced apart slots 45, the cam follower roller 41 and bushing 42 being thus slidably received in the roller follower slot 54. Then, with the upper portions 62 at opposite ends of the roller shaft 43 in abutment against their respective associated fillets 58, the tang 46 are then forced from the as formed position shown in FIG. 3 toward each other about the associated lower portion 62 of the roller shaft 43 to the positions shown in FIG. 2 whereby each pair of opposed tangs 46 partly encircle an end portion of the roller shaft. By having the lower exterior portion 62 at each end the roller shaft 43 of arcuate configuration, such as semi-circular, the tangs 46 can be bent into corresponding configuration, thus eliminating any sharp angle bending of these tangs.

With the roller then secured by the bent-over tangs 46 to the cylindrical member 10, the cam follower roller assembly 40 is prevented from separating from the cylindrical follower 10 of the hydraulic valve lifter if a no-follow condition of the valve train should occur during engine operation. Also, as previously described, by providing the abutment shoulder 63 at opposite ends of the journal portion 61, axial movement of the roller shaft 43 within the cylindrical follower is limited whereby this shaft cannot be axially forced out of the cylindrical follower 10.

What I claim as new and desire to secure by Letters Patent of the United States is:

1. In a valve tappet of the type including a follower with a cam follower roller rotatably journaled on a roller shaft, the improvement wherein said follower has two pairs of oppositely facing depending struts thereon with a roller space therebetween, each said strut including a depending tang at the free end thereof; each said pair of said struts having a shaft space between facing said struts aligned with the shaft space of the other said pair of said struts and, wherein said roller shaft includes an intermediate circular journal portion on which said cam follower roller is journaled and free end portions at opposite ends thereof; each said free end portion having opposed flats thereon, each said flat being connected by a radial abutment shoulder to said circular journal portion, said free ends with said flats thereon of said roller shaft being slidably received in said shaft spaces with said roller shaft then retained against axial movement in opposite directions by abutment of the said abutment shoulders against said struts, the free ends of said depending tangs of each said pair of said struts being positioned so as to at least partly encircle said free end portions of said roller shaft whereby to retain said roller shaft and therefor the cam follower roller to said follower in unit assembly therewith.

2. In a valve tappet assembly of the type including a cam follower roller rotatably journaled on a roller shaft supported on follower of the assembly, the improvement wherein said follower is a two-part assembly consisting of a cylinder follower member and a roller shaft retainer fixed to one end of the cylinder follower member; the roller shaft retainer having two pairs of oppositely facing depending strut means thereon with a roller space therebetween, each said pair of said strut means having a shaft space between facing struts of said strut means aligned with the shaft space of the other said pair and, wherein said roller shaft includes an intermediate circular shaft portion on which said cam follower roller is journaled and opposite free end portions each with opposed flats thereon, said flats being connected by radial shoulders to said circular shaft portion, said free ends of said roller shaft with said flats thereon being slidably received in said shaft spaces whereby said roller shaft is retained for limited axial movement in opposite directions by abutment of said radial shoulders against said strut means, the free ends of said pairs of depending strut means including bent-over tangs positioned to at least partly encircle said free end portions of said roller shaft whereby to retain said roller shaft and therefor said roller to said follower in unit assembly therewith.

* * * * *